US009374859B2

(12) United States Patent
Pop

(10) Patent No.: US 9,374,859 B2
(45) Date of Patent: Jun. 21, 2016

(54) LIGHTING INTERCONNECTION AND LIGHTING CONTROL MODULE

(71) Applicant: Advancetrex Corporation, Rosemont, IL (US)

(72) Inventor: Florin Pop, Glenview, IL (US)

(73) Assignee: ADVANCETREX CORPORATION, Rosemont, IL (US)

( * ) Notice: Subject to any disclaimer, the term of this patent is extended or adjusted under 35 U.S.C. 154(b) by 0 days.

(21) Appl. No.: 14/276,662

(22) Filed: May 13, 2014

(65) Prior Publication Data

US 2015/0069914 A1 Mar. 12, 2015

Related U.S. Application Data

(60) Provisional application No. 61/876,405, filed on Sep. 11, 2013.

(51) Int. Cl.
*F21S 2/00* (2016.01)
*H05B 33/08* (2006.01)

(52) U.S. Cl.
CPC ..... *H05B 33/0815* (2013.01); *H05B 33/0827* (2013.01); *H05B 33/0866* (2013.01)

(58) Field of Classification Search
CPC ..... F21S 2/00; F21S 2/005; H05B 33/0845; H05B 33/0857; H05B 33/0821
USPC ..... 362/225, 249.02, 249.01, 800, 311.01, 362/634, 219, 309, 646, 276, 261–265; 315/185 R, 289, 169.3, 113, 149
See application file for complete search history.

(56) References Cited

U.S. PATENT DOCUMENTS

| | | | | |
|---|---|---|---|---|
| 6,942,360 | B2 * | 9/2005 | Chou et al. | 362/238 |
| 7,322,718 | B2 * | 1/2008 | Setomoto et al. | 362/276 |
| 2003/0193789 | A1 * | 10/2003 | Karlicek, Jr. | H01R 29/00 361/760 |
| 2006/0221608 | A1 * | 10/2006 | Ishizuka | F21K 9/00 362/227 |
| 2009/0237007 | A1 * | 9/2009 | Leng | 315/297 |
| 2012/0281412 | A1 * | 11/2012 | Hente et al. | 362/249.02 |

FOREIGN PATENT DOCUMENTS

| | | | |
|---|---|---|---|
| WO | 2012041456 | A1 | 4/2012 |
| WO | WO 2012041456 | A1 * | 4/2012 |

OTHER PUBLICATIONS

Author: Petra Heusel, Title: Lighting System, Date: Sep. 22, 2011 (WO 2012/041456 A1) [Translation].*
Author:Heusel Petra, Title: Lighting system, Date:Apr. 5, 2012 1-44 pages.*
Author:Heusel Petra, Title: Lighting system, Date:Apr. 5, 2012 1-44 pages (Translation).*
International Search Report for PCT/US2014/054870 dated Dec. 22, 2014, ten pages.

* cited by examiner

*Primary Examiner* — Thai Pham
*Assistant Examiner* — Wei Chan
(74) *Attorney, Agent, or Firm* — Klintworth & Rozenblat IP LLC

(57) ABSTRACT

A light module includes lighting elements. The lighting elements including a light emitting diode, a power block a constant current driver and power terminals. The lighting elements are connected together vertically and horizontally by the power terminals to form a shape.

25 Claims, 10 Drawing Sheets

LIGHTING INTERCONNECTION AND LIGHTING CONTROL MODULE

CROSS-REFERENCE TO RELATED APPLICATIONS

This application is a continuation of U.S. Provisional Application Ser. No. 61/876,405, filed Sep. 11, 2013, the entire contents of which are incorporated by reference herein.

BACKGROUND

Light emitting elements, e.g., light-emitting diodes (LEDs), emit visible light when an electric current passes through it. The output from an LED can range from red (at a wavelength of approximately 700 nanometers) to blue-violet (about 400 nanometers). Some LEDs emit infrared (IR) energy (e.g., 830 nanometers or longer). The light emitting elements have a transparent package, allowing visible or IR energy to pass through to be seen by a viewer.

BRIEF DESCRIPTION OF THE DRAWINGS

In association with the following detailed description, reference is made to the accompanying drawings, where like numerals in different figures can refer to the same element.

DETAILED DESCRIPTION

A system and method connect light emitting elements on a surface. For purposes of explanation, the light emitting elements are described as LEDs, but other types of light emitting elements can be used. Mechanical and electrical connections are used to connect adjacent LEDs and/or groups of LEDs to a surface. The covered surface can be split into different controllable zones and any LED or group of LEDs can be addressed, e.g., using a digital modulation for addressable lighting elements 110.

Figure 1A:
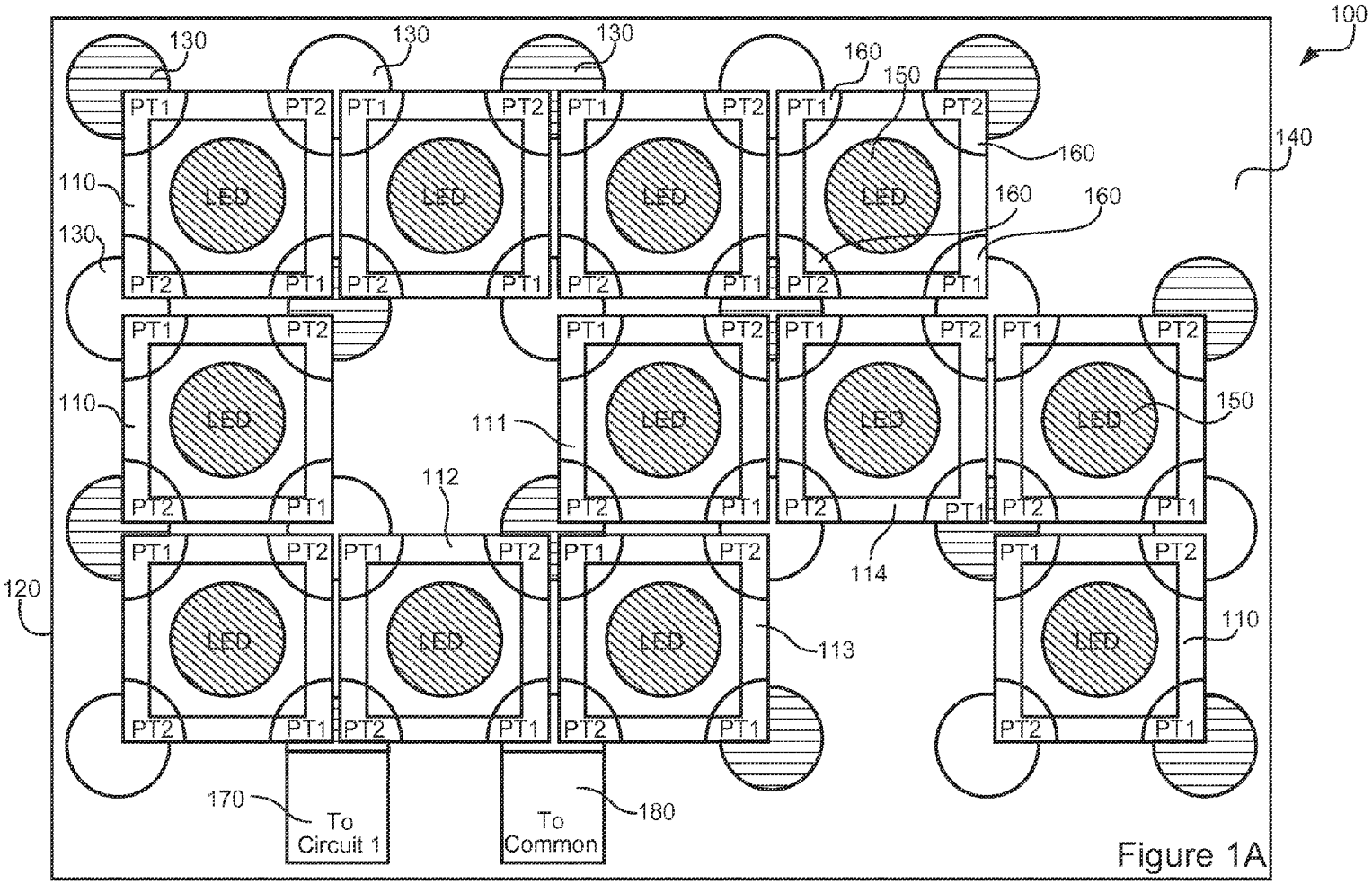
FIGS. 1A and 1B are a front view of an exemplary light module.
Figure 1B:
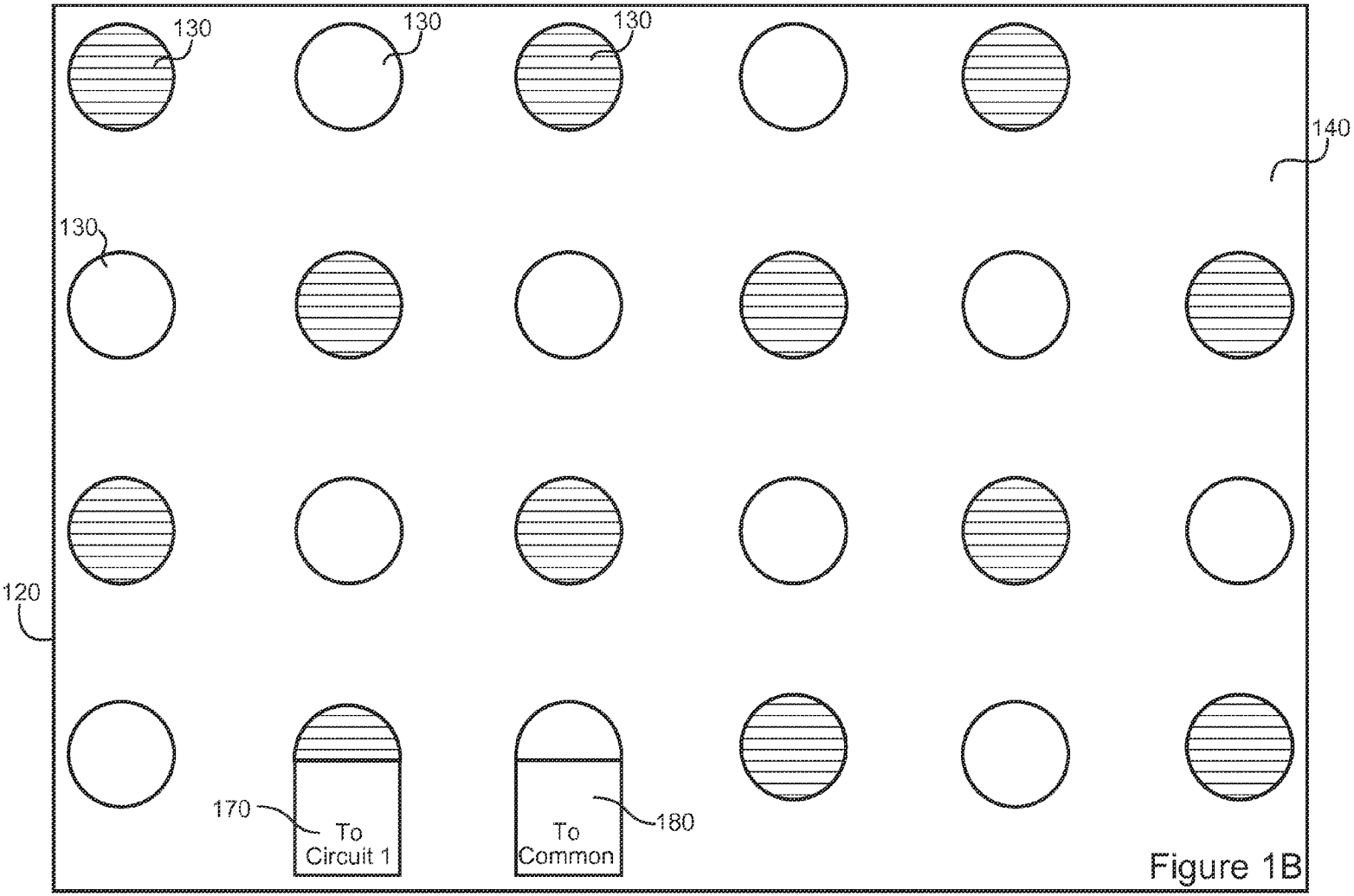

FIGS. 1A and 1B are a front view of an exemplary light module 100. The light module 100 is made up of a cluster of lighting elements 110 interconnected via a connection modules 120. The connection module 120 includes a plate to with connection elements 130 positioned on a surface 140 to mechanically and electrically connect a cluster of lighting elements 110 to each other. The lighting elements 110 can be made of an LED 150, or other light emitting element, and contact elements 160. The contact elements 160 connect the lighting elements 110 together. The contact elements 160 mechanically and electrically connect the lighting elements 110 to the connection elements of the connection module 120. A power circuit terminal 170 connects with half the connection elements 130 and the other half of the connection elements 130 are connected with common or ground 180. For example, the power circuit terminal 170 connects with the horizontally shaded connection elements 130 and the common 180 connects with the unshaded connection elements 130, see, e.g., FIG. 1B with the lighting elements 110 removed for a clearer view. Diagonal columns of power connection elements are positioned adjacent to diagonal columns of common connection elements. In that way each lighting element 110 connects with two adjacent power elements and two adjacent common elements, and clusters of lighting elements 110 connect with a shared power and ground. The power circuit terminal 170 and the ground terminal 180 can include metallic elements which connect to the power supply that powers the light module 100, e.g., an AC/DC power supply for non-controllable modules or a driver that digitally modulates the power from an AC/DC power supply.

The connection elements 130 allow for the lighting elements 110 to be positioned in a pattern on the connection module 120, to form a lighting pattern, e.g. a picture, a symbol, letters of words, etc. The power terminals PT1 and PT2 of the lighting elements 110 electrically connect to the connection elements 130 of the light module 100. The light module 100 can be used in different implementations, e.g., signs, televisions, monitors, jumbotrons, etc. The LED housings can be colored or the wavelength of the power to the LEDs can be varied to create different colors. A light sensor can send signals to match a color temperature or a color of the light sensed by the sensor. Dimming information related to a determined color intensity can then be sent to specified lighting elements 110 to produce a desired color/temperature color at the lighting elements 110. For example, an external sensor can be present to measure the light intensity and adjust the LED intensity to maintain the same lighting level during night or day, or to adjust the color temperature in the room, e.g., for mood control. In one implementation, the light module 100 can be placed in a room which is lit by both the light module 100 and the sun through windows, to replicate the sunlight through the windows.

Figure 2:
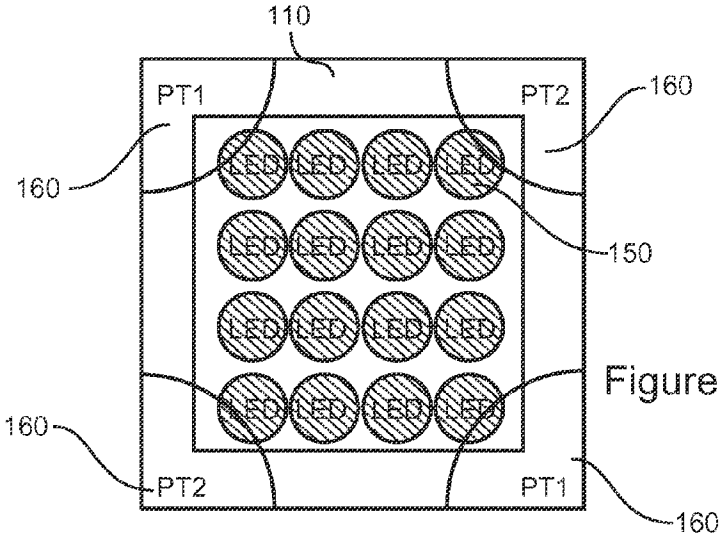
FIG. 2 is a front view of another exemplary lighting element.

FIG. 2 is a front view of another exemplary lighting element 110. The lighting element 110 can use a single LED 150 as shown in FIG. 1A or a string of LEDs. The string of LEDs can include a matrix of LEDs for each lighting element 110, as shown in FIG. 2, or other numbers or shapes of strings of LEDs per lighting element 110. Each LED in the string of LEDs can include their own driver circuit to be driven separately, e.g., using the techniques described herein. The LED strings allow PWM dimming or digital independent or group addressing. The control signal can be sent to entire light module 100 using power modulation. Each lighting element 110 includes a power block (see, e.g., FIG. 5) which provides the power for driver and decodes the identification, on/off, dimming, etc. information. If the information addresses one lighting element 110, the intensity of the LED or LED string of the lighting element 110 is adjusted accordingly. Each lighting element 110 receives the information, e.g., transmitted over the power line. The lighting element 110 decodes the identification information of the control signal to determine whether or not to follow the instructions of the signal. Exemplary analog and digital circuitry for a power block (e.g., FIG. 5) to implement an address decoder is described below. The power terminals PT1 and PT2 located on the corners of the lighting elements 110 allow the signal information to be simultaneously received by all the lighting elements 110 of the light module 100. The neutral polarity of power terminals PT1 and PT2 (any of them can be either + or −) and symmetrical terminal placement (e.g., diagonal) configure the lighting elements 110 to be positioned horizontally and vertically anywhere on the light module 100, e.g., to form a shape of lighting elements 110 on the lighting module 100.

The lighting element 110 of FIGS. 1 and 2 can include pie-shaped contact elements 160 to be placed at the corners of the connection module 130. Other shapes of contact elements 160 can be used. With the pie-shaped contacts 160 the connection element 130 can accommodate connections with up to four adjacent lighting elements 110. A first lighting element 111 can share a connection element 160 with a second lighting element 112, two connection elements third lighting element 113, two connection elements with a fourth lighting element 114, etc. up to eight lighting elements can surround the first lighting element 111. The additional lighting elements be positioned in various directions related to the first lighting element 111, e.g. to the below the first lighting element 111, to the right of the first lighting element 111, diagonal to the first lighting element, etc.

Figure 3:
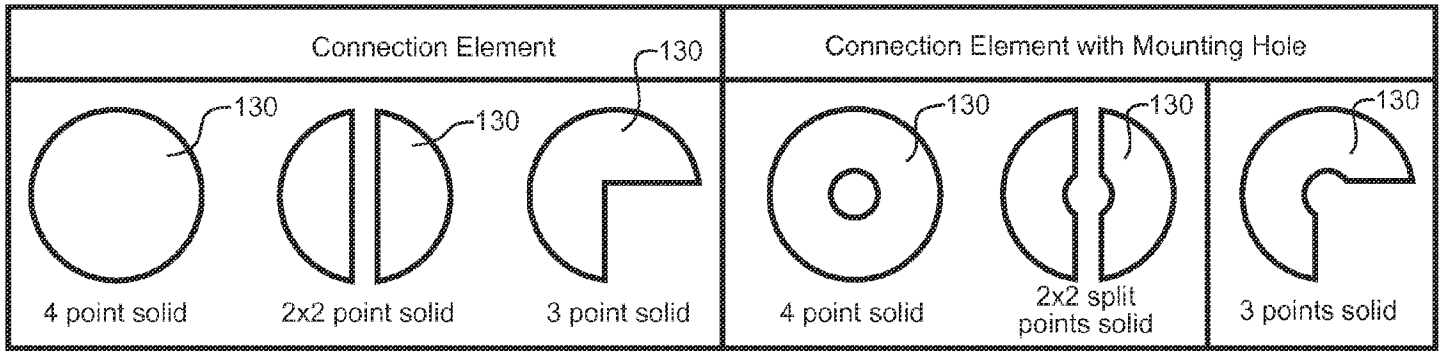
FIG. 3 is a front view of exemplary connection elements.

FIG. 3 is a front view of exemplary connection elements 130. The connection elements 130 can include any shape, e.g., square, rectangular or round. The connection elements 130 can be pluggable, e.g., with clamping contacts for the contact element 160 to fit in, or the connection can be made in other ways, e.g., with a sandwich of two elements which keeps together the corners and are fastened using a central screw. The connection element 130 can include differing number of contact points, e.g., four points, 2×2 points, 3 points, 2 points, 1 point, 2×2 split points, etc. Other shapes or fastening methods are possible too.

Also referring to FIGS. 1A and 1B, the lighting elements 110 are connected to the power circuit terminal 170 using the diagonal power and common contact elements 160 to connect with the corresponding diagonal connection elements 130, shown with vertical line shading. The other diagonal contact elements 160 are connected to common 160 via the connection elements 130, shown with no shading. In this way, any two adjacent contact elements 160 can be used to power the lighting element 110. The diagonal power connections and interleaved diagonal common connections create a power matrix of connection elements 130 which can provide distributed voltage and current to each of the lighting elements 110 connected with the connection elements 130. Power is transmitted between lighting elements 110 through any adjacent direction.

The surface 140 can be covered with lighting elements 110 and the quadruple connections can ensure multiple current paths which distribute the power to the lighting elements 110. Since the lighting elements 110 are powered from one to another through any two adjacent connections, dimming and/or address information can be sent to the lighting elements 110 by modulating the power line voltage sent to the power circuit terminal 170. The connection elements 130 and/or the surface 140 can be used as thermal dissipation pad to dissipate heat from the lighting elements 110 without the need for an independent lighting element heat sink. For example, the connection elements 130 can be connected to ground of the system through connector screws and a backside of the surface 140 can sink heat.

Figure 4:
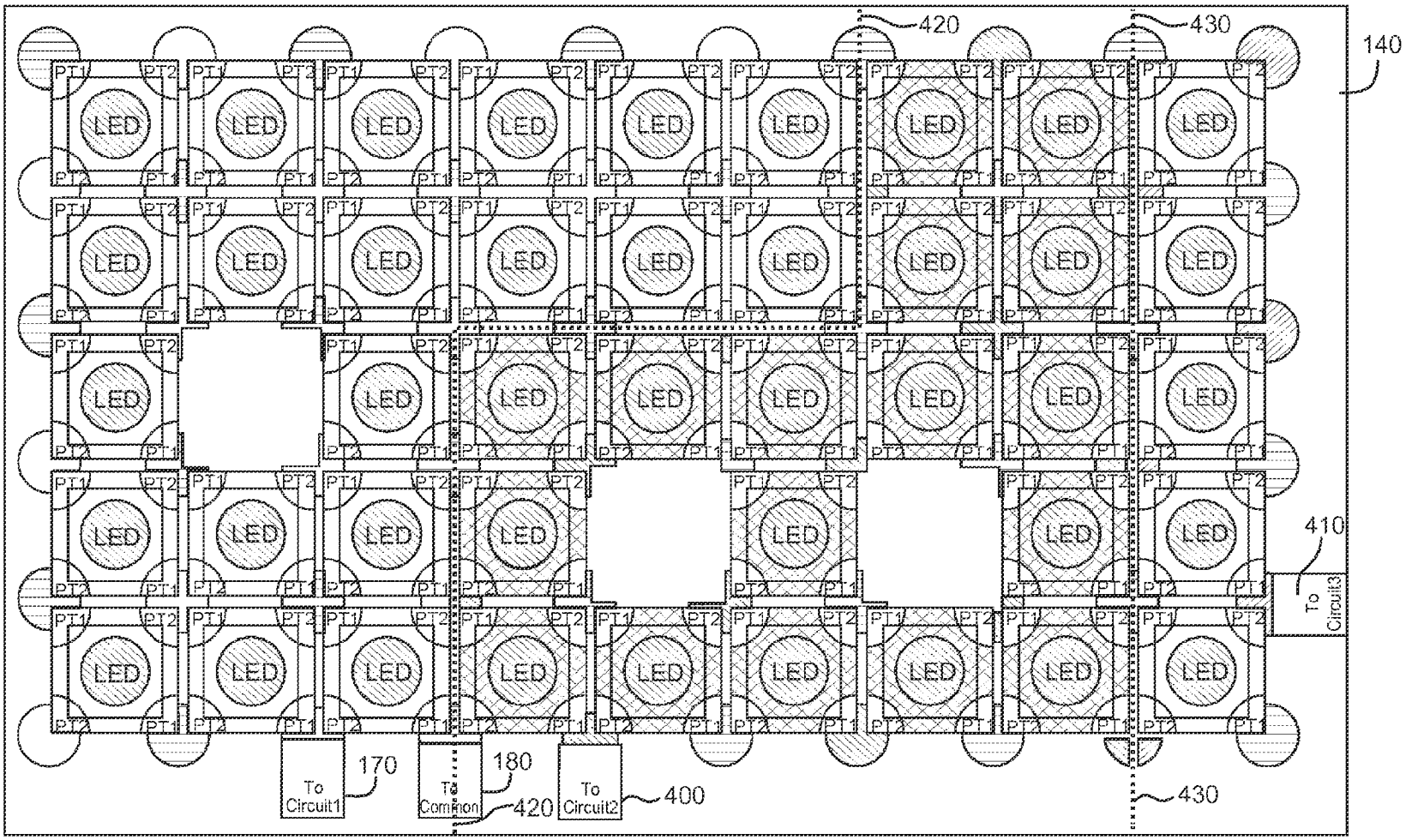
FIG. 4 is a front view of another exemplary light module, with two additional power circuits and added.

FIG. 4 is a front view of another exemplary light module 100, with two additional power circuits 400 and 410 added. In one implementation, a light module 100 with non-addressable lighting elements 110 is described. Various electrically isolated sections of the light module 100 can be driven by their own circuitry. For example, the first power circuit terminal 170 can drive the connection elements 130 shown with vertical line shading, the second power circuit terminal 400 can drive the connection elements 130 shown with diagonal shading, and the third power circuit terminal 410 can drive the connection elements 130 shown with horizontal shading. The power is transmitted from one lighting element 110 to another by side connections. If a connection path (e.g. 420 and 430) is interrupted, the power supply for various lighting elements 110 will be split as well. The demarcation lines 420, 430, isolate clusters of lighting elements 110, like putting two light modules 100 with various shapes side-by-side to cover the surface 140. In this way, different clusters of lighting elements 110 can be powered independently of each other and/or dimmed independently.

To build the electrically isolated sections, the lighting elements 110 can be arranged as desired to cover the surface 140. The demarcation lines 420, 430, shown with dotted lines, are determined that separate the different regions of lighting elements 110. A starting point is determined for the common electrodes, e.g., unshaded connection elements 130. The common electrodes are placed at diagonals starting from first common electrode point 180 even if it crosses the border region to generate the common electrode for the entire structure. For each additional circuit, any point which is not already a common electrode is determined to be a power circuit electrode, and the diagonal rule is applied until reaching a demarcation line 420, 430. At the demarcation lines 420, 430, a split element can be used for a regular border and a three point element can be used for the zone corners. By following this, the surface 140 can be split into different zones, and each zone controlled using addressable or non-addressable lighting elements 110.

Figure 5:
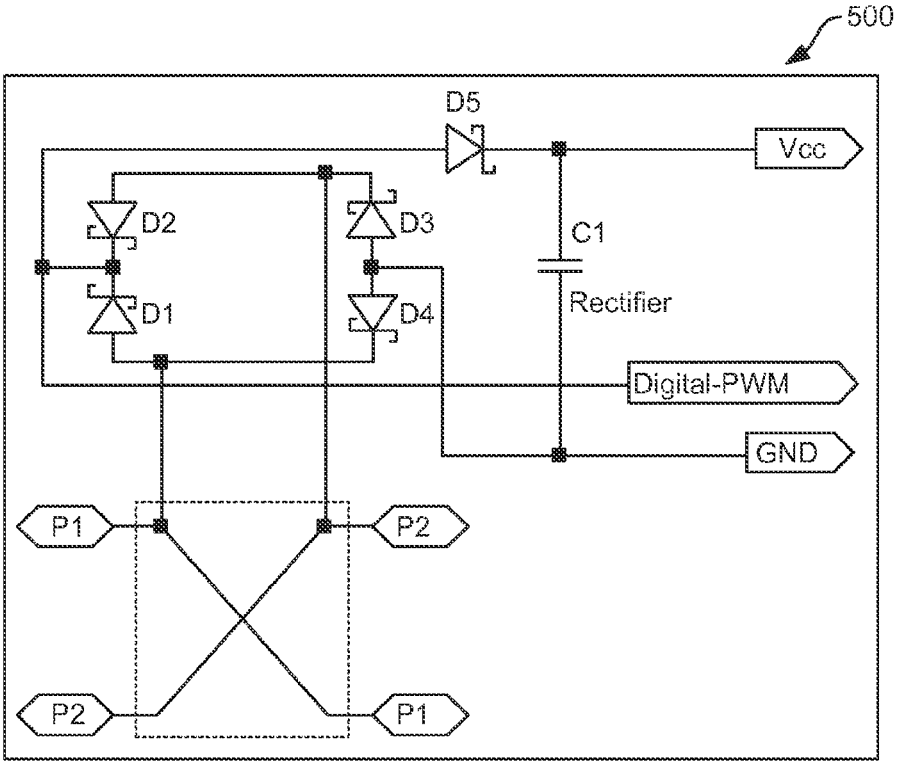
FIG. 5 is a circuit diagram of an exemplary power block used in a lighting element.

FIG. 5 is a circuit diagram of an exemplary power block 500, e.g., used in the lighting element 110. The power block 500 provides power for an LED driver (e.g., drivers of FIGS. 6 and 8-11) and decodes a control sequence to obtain address, on/off, dimming, etc. information from control signals sent over the power line. The control sequence can be transmitted by modulating the voltage on the line. Each lighting elements 110 can include its own power block 500 to ensure continuous power to LED driver circuit (C1 will hold the energy during modulation) and extract the control information. The power block 500 is integrated into the lighting element 110 and/or connected with the lighting element 110. Each lighting element 110 includes its own power block 500.

Both the power block 500 and the LED can be connected with a common surface of the lighting element 110. Each lighting element 110 can sink heat, e.g., via a heat sink on the LED. The power block 500 can make the lighting element 110 easily connectable and controllable since each lighting element includes its own power block 500. Moreover, the arrangement of the power terminals PT1 and PT2 provide for the lighting elements 110 to be inter-connected in any orientation without affecting a functionality of the lighting element 110. For example, the lighting elements can be connected to each other in a 0 degree, 90 degree, 180 degree or 270 degree orientation because the power terminals PT1 and PT2 are placed on diagonal, and the voltage polarity at any two adjacent corners is opposite, allowing for power to be transmitted from one lighting element to another. The lighting elements 110 can be placed in any position on the connection module 120 and can make the electrical bridge between adjacent connection elements 130. The connection element 130 can also mechanically fasten the cluster of lighting elements 110 to the surface 140.

Diagonal terminals of the lighting element 110 are connected together and both feed a diode bridge D1, D2, D3, D4, e.g., efficient schottky diodes. The bridge feeds the rectifier capacitor C1 through another diode D5. The value of rectifier capacitance is selected as big as needed to keep the required energy during a complete modulation cycle. To communicate with the module, the Vcc is amplitude modulated, for example Vcc_HI=24V and Vcc_LOW=21V. Because the energy is drawn from rectifying capacitors during the Vcc_LOW half-period, the voltage across diode D5 has negative values. If the voltage on the D5 anode is compared with Vcc, there is HI when Vcc is Vcc_HI and LOW when Vcc is Vcc_LOW. The diode D5 is used to extract the dimming modulation from power voltage Vcc. Therefore, the LED or string of LEDs of the lighting element 110 can be modulated or digitally dimmed. Implementations for the driver circuit are described below.

Figure 6:
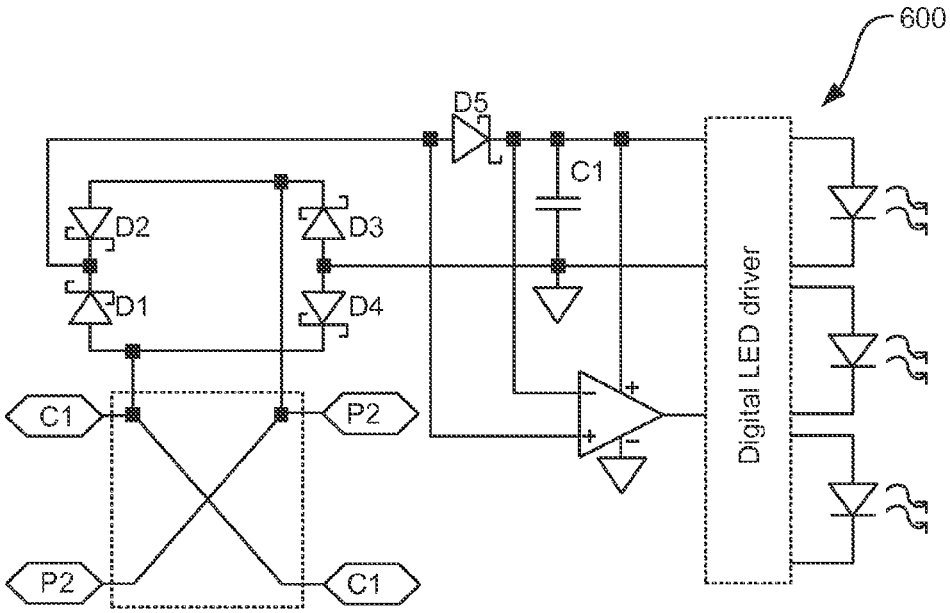
FIG. 6 is a circuit diagram for an exemplary configuration of the power block of FIG. 5 connected with a driver.

FIG. 6 is a circuit diagram for an exemplary configuration of the power block of FIG. 5 connected with a driver 600, e.g., a digital LED driver. The power supply charges capacitor C1 and powers the driver 600 during the ON period, and capacitor C1 powers the driver 600 during the off period.

Figure 7:
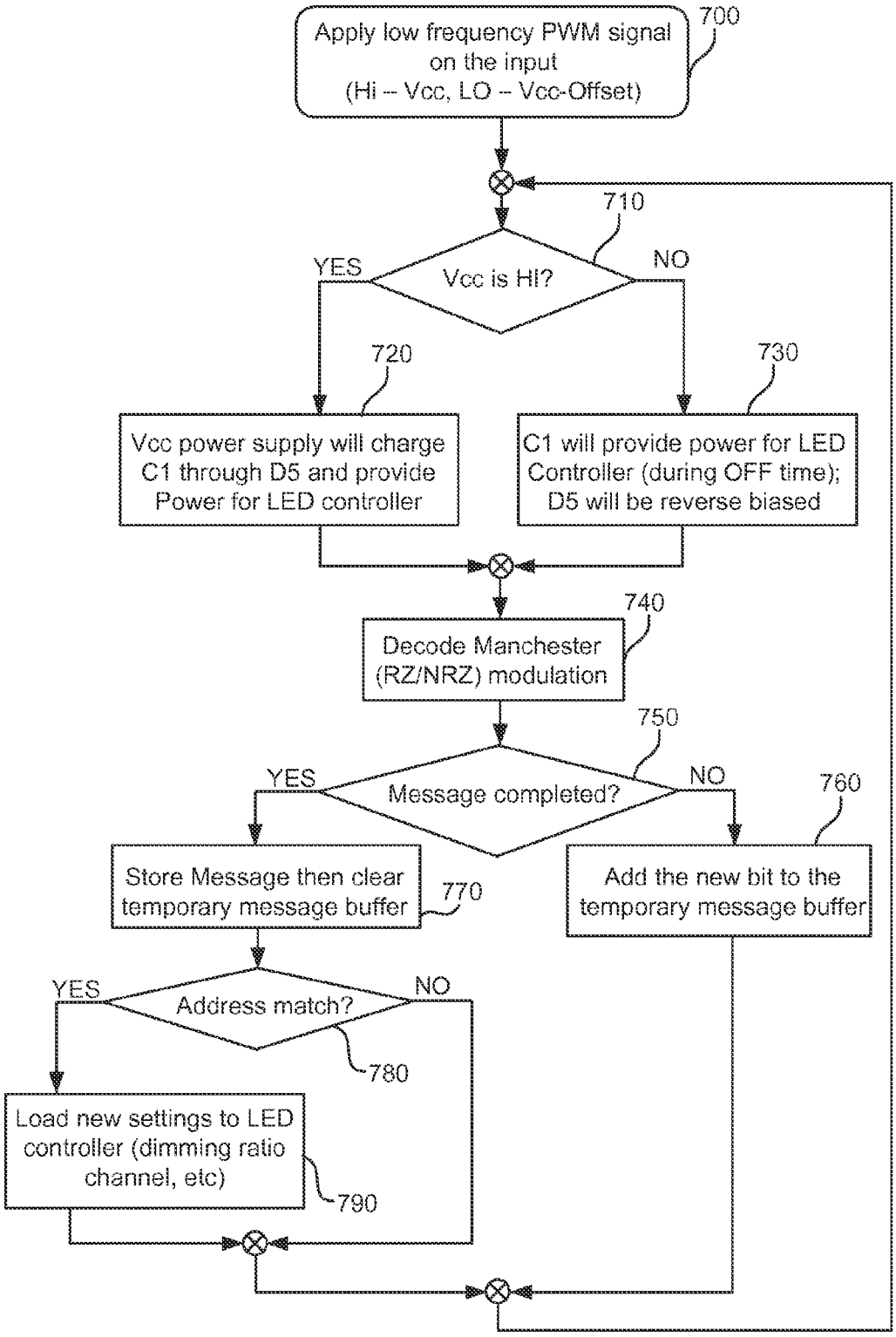
FIG. 7 is a flow chart of an exemplary function of the driver circuit of FIG. 5 and FIG. 6.

FIG. 7 is a flow chart of an exemplary function of the driver circuit of FIG. 5 and FIG. 6. A low frequency PWM signal is applied on the input (HI—Vcc, LO—Vcc—offset) (700). If Vcc is HI (710), the Vcc power supply charges capacitor C1 through diode D5 and provides power for LED control (720). If Vcc is not HI, capacitor C1 provides power for the lighting element 110, during the OFF time, and diode D5 is reverse biased (730). Messages, e.g., Digital return-to-zero (RZ) or non-return to zero (NRZ) messages, sent to the lighting element 110 can be decoded. In one example, the messages are Manchester modulation encoded messages (740). RZ and NRZ modulation can limit a time when the signal is low since. During a low state, the capacitor C1 feeds the LED driver that powers the LED so, the capacitance is related to a maximum allowable low time. But other types of modulation can be used. If the message is not completed (750), the new bit can be added to a temporary message buffer (760) to await the remainder of the message. If the message is completed (750), the message can be stored for processing and the temporary message buffer cleared (770). If an address of the message matches an address of the lighting element 110 (780), new settings can be loaded, e.g., to the digital LED driver, including dimming ratio, channel, etc. (790).

Figure 8:
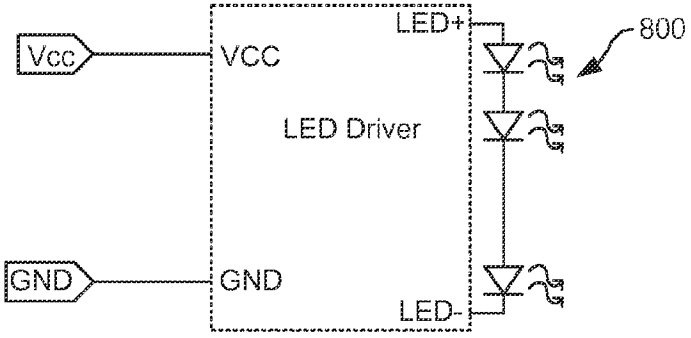
FIG. 8 is a circuit diagram of an exemplary driver (e.g., direct current (DC) to DC regulator) which supplies a constant current to an LED or LED string.

FIG. 8 is a circuit diagram of an exemplary driver (e.g., direct current (DC) to DC regulator) which supplies a constant current to an LED or LED string. As described above, the LED for each lighting element 110 can include a single LED or string of LEDs. The circuit can preserve the brightness of the LED or LED stings constant for a wide range of applied input voltage and can be turned ON/OFF when disconnected from the power. On example of the circuit is a switching (e.g., buck) current regulator, without the need for dimming capabilities.

Figure 9:
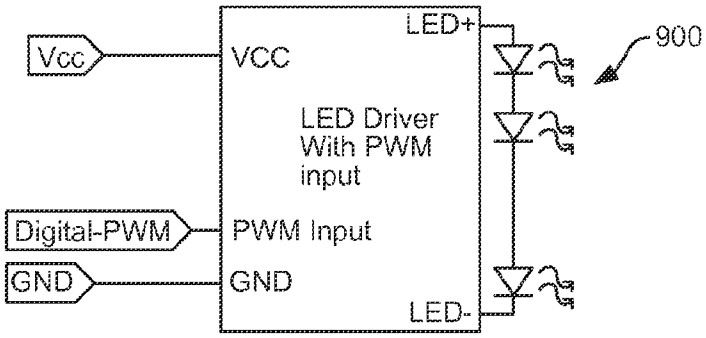
FIG. 9 is a circuit diagram of an exemplary driver circuit with PWM dimming capability to allow light intensity control for an LED or LED string.

FIG. 9 is a circuit diagram of an exemplary driver circuit with PWM dimming capability to allow light intensity control for an LED or LED string. The modulation signal is applied to the PWM dimming input of the LED driver. When the power voltage is modulated (e.g., 20V—LOW/24V—HI), the LED intensity become proportional with the duty cycle of the modulation signal. The voltage variation does not affect the LEDs intensity so that the lighting elements deliver the same intensity in accordance with the PWM duty cycle. The LED current is kept constant regardless of the voltage on input. For example, the DC-DC regulator can regulate the current for an input voltage between, for example, about 8-30V. If there is a quick drop for a limited amount of time, the power block 500 can extract the signal and decide during the drop time to turn off the LED. If the variation is too slow the capacitor C1 may follow the input voltage and the voltage modulation does not affect the LED intensity, e.g., the voltage on the capacitor is maintained above a minimum LED drive working voltage.

Figure 10:
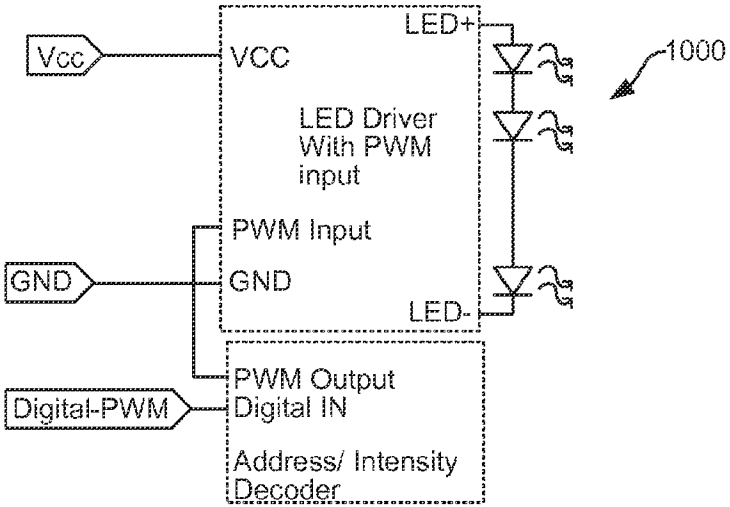
FIG. 10 is a circuit diagram of an exemplary driver circuit with addressable lighting elements.

FIG. 10 is a circuit diagram of an exemplary driver circuit 1000 with addressable lighting elements 110. The address can be selected from a switch of the lighting elements 110 or written to an internal electrically erasable programmable memory (EEPROM) before installation. Lighting elements 110 from a group can use the same identification (ID). Using the addressable IDs, individual lighting elements 110 and/or lighting elements 110 of the same group can be controlled at the same time, e.g., to provide a lighting effect. A controller connected with the power supply supplying power to the light module 100 can modulate the power supply (Hi/Lo—24/21V) value that powers the entire light module 100. The digital modulation is received and decoded by each lighting element 110 and the dimming is accordingly adjusted for each LED or LED string. Pulse position modulation or Manchester encoding, for example, can be used to minimize the requirement for rectifier capacitor. Any other base band modulation can be used, e.g., that limits the time when the power supply will be Lo. The modulated signals with the address, dimming, power on/off etc. information can be transmitted over the power lines from the controller to control specified operation the lighting elements 110 of the light module 100, e.g., dim, change a frequency/color, turn on/off, address a specific colored LED, etc. The digital sequence can contain the group address and the intensity level followed by a checksum.

Figure 11:
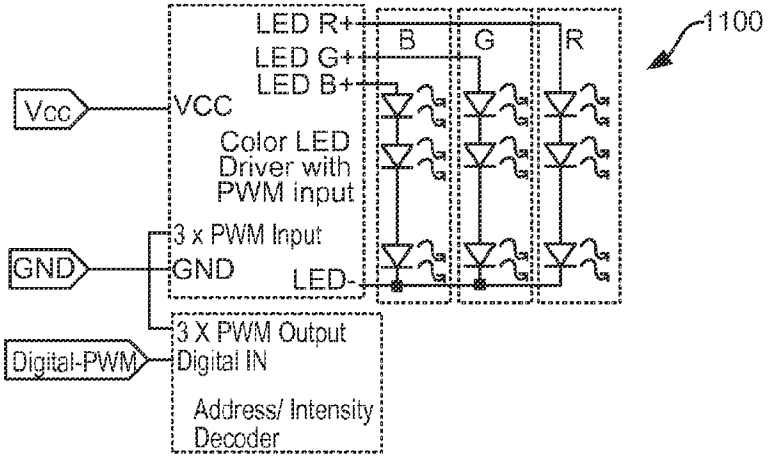
FIG. 11 is a circuit diagram of an exemplary driver circuit with multiple LED branches with independent adjustable intensities.

FIG. 11 is a circuit diagram of an exemplary driver circuit 1100 with multiple LED branches with independent adjustable intensities, e.g., for dimming multiple LEDs or LED strings. A double or triple DC-DC current regulator can drive two (for temperature controlled lamps) or three (RGB lamps) strings of LEDs. The digital sequence contains the group address then two or three bytes for LED string intensity followed by the checksum. Other numbers of current regulators can be used.

Figure 12:
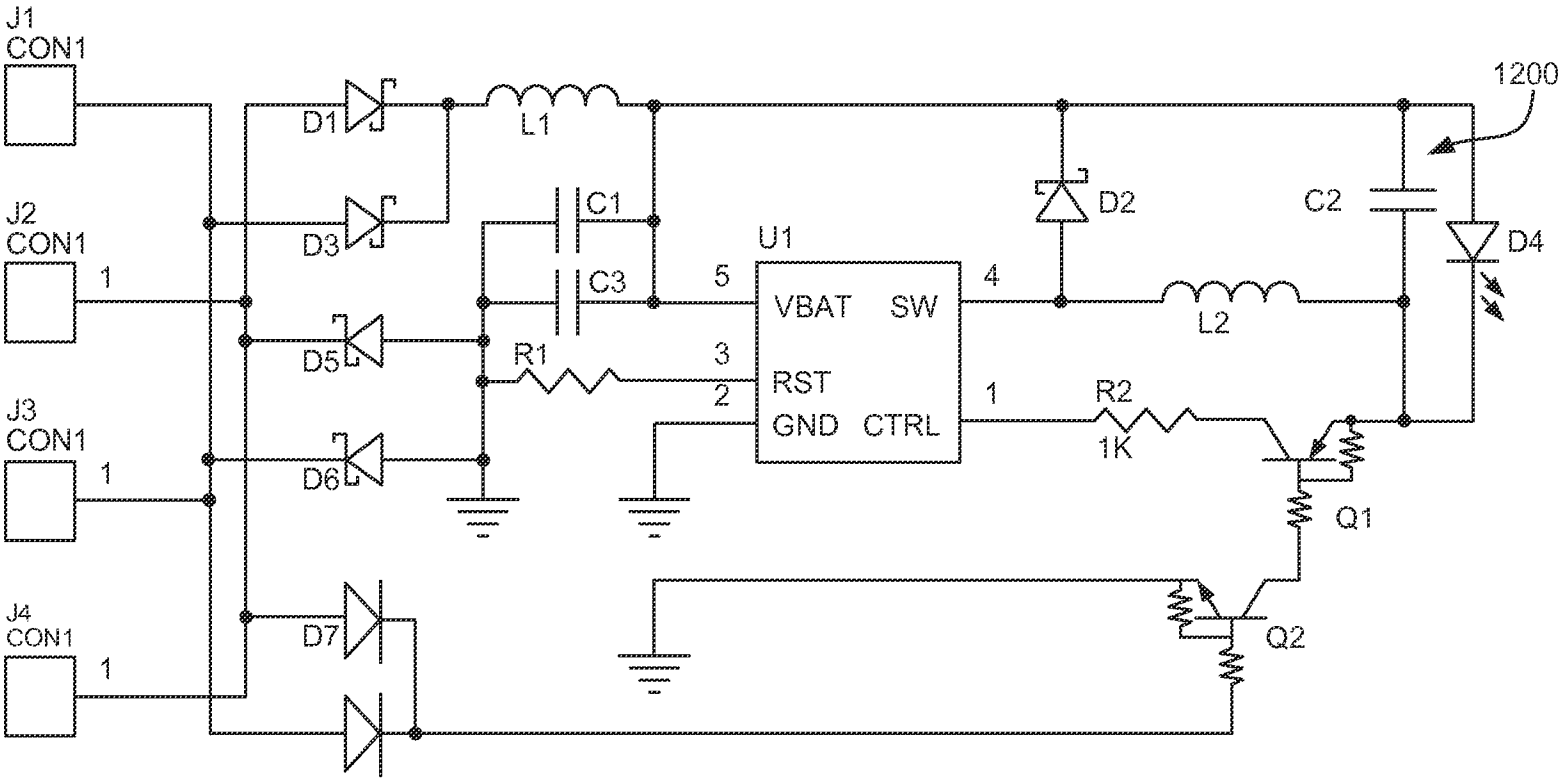
FIG. 12 is a circuit diagram of an exemplary on/off, non-addressable application of a dimmable driver.

FIG. 12 is a circuit diagram of an exemplary on/off, non-addressable application of a dimmable driver. When the voltage is applied between J1-J2 or J1-J4 or J2-J3 or J3-J4, e.g., power terminals PT1 and PT2 interlaced on the lighting elements 110, regardless of power supply polarity because the voltage is rectified by diodes D1-D3-D5-D6 (e.g., MBRX140 type diodes), the capacitors C1 and C3 (e.g., 4.7 microfarads) start charging through inductor L1 (e.g., 220 nanohenry) up to Vcc and processor U1 (e.g., CAT4201) is biased with line voltage on VBAT input. In this implementation, C1 is placed in parallel with C3 to increase the overall capacitance when using ceramic capacitors. Additional or fewer capacitors can be used depending on the size of the capacitors and the desired capacitance for an implementation.

SW is the switching point, e.g., of a buck regulator switching supply. RST pin is used to set the LED current which the buck regulator regulates. The current through LED diode D4 (350 mA LED) is regulated by U1 based on the duty cycle of the voltage at node SW. The duty cycle can adjusted to maintain the LED intensity constant. Q1 (e.g., BCR 185) and Q2 (e.g., BCR135) disable U1 which turns off U1 (CTRL input<0.4V) when the power rail voltage is Low (<1V). In this example, the LED is ON when the power is HIGH and the LED is OFF (e.g., right away) when the power is missing, e.g., 0V. Any other variation of the power rail voltage does not affect the intensity of lighting. Each lighting element 110 lights with the same intensity regardless of applied voltages. This helps to avoid intensity mismatch for a bigger surfaces covered by the lighting elements 110. When the power is modulated down to 0, the LED turns on and off, and as result the intensity will be proportional with the power rail duty cycle. During the ON time, a half of diode D7 (e.g., BAV70) is in conduction, so switch Q2 is biased and turned ON which turns on switch Q2 that turns on Q1 and the CTRL pin is pulled high through the LED. If the LED is disconnected or CTRL pin is grounded U1 turns OFF. At switch Q1 the emitter voltage value is bigger than ground and the base of switch Q1 is kept grounded by switch Q2. When switch Q1 is biased, the CTRL pin (the shutdown pin) of processor U1 is activated, where CTRL>1.2V U1 is switching. If switch Q1 is not biased the CTRL<0.9V U1 is OFF.

If Vcc is off, even for a short period of time, which is the case with a PWM type Vcc voltage, during the OFF time, double diode D7 is not conducting, which turns OFF switch Q2. Then switch Q1 and processor U1 are shut down, which turns OFF the diode D4 (LED). In that way, the output intensity is the average of intensity during a period, e.g., low intensity for a low duty cycle and high intensity for a high duty cycle. The LED intensity does not depend on voltage applied to a lighting element but it is a function of modulated power supply voltage. Therefore, a maximum light intensity can be achieved when Vcc is turned steady ON without being affected by any drop in voltage across power connection, e.g., duty cycle is 100%.

Figure 13:
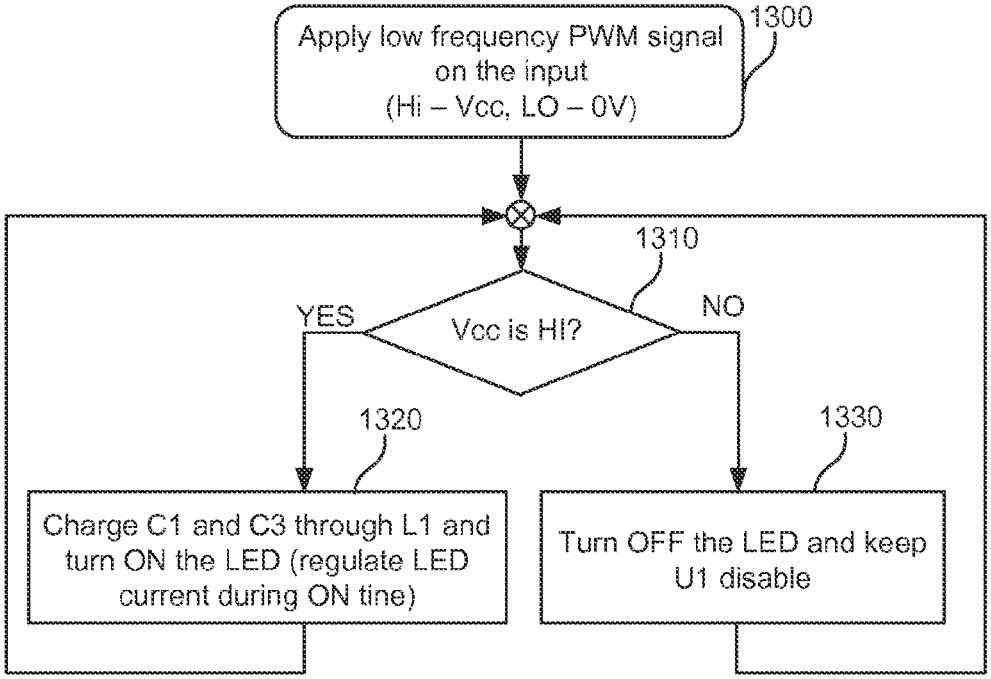
FIG. 13 is a flowchart of an exemplary function of the circuit of FIG. 12.

FIG. 13 is a flowchart of an exemplary function of the circuit of FIG. 12. A low frequency PWM signal can be applied to the driver circuit 1200 of the lighting element 110 (1300). The PWM signal can be either HI—Vcc, or LO—0V. If the power rail is HI (Vcc), then capacitors C1 and C3 are charged through inductor L1 which turns ON the diode D4 (LED) and regulates power to the diode D4 (LED) during the ON time. If Vcc is not HI, e.g., Vcc is LO, then diode D4 (LED) is turned OFF, and processor U1 is disabled.

Figure 14:
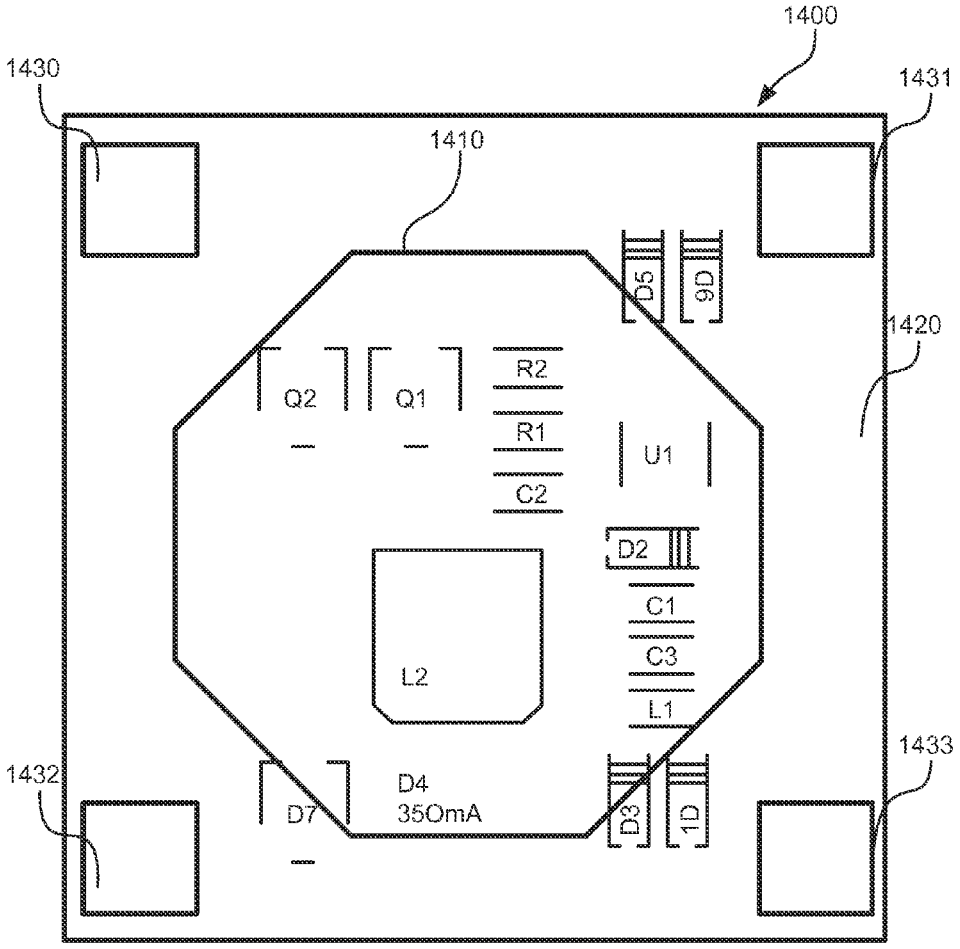
FIG. 14 is a circuit diagram of an exemplary components placement of the lighting element including the circuitry of the driver circuit of FIG. 12.

FIG. 14 is a circuit diagram of an exemplary component placement of an exemplary lighting element 1400 including the circuitry of the driver circuit 1200 of FIG. 12. The lighting element 1400 includes an LED or other light positioned on a surface 1420. Four contact elements 1430, 1431, 1432, 1433 are configured to mechanically and electrically connect with connection elements 130 described above. Diagonal contact elements 1430, 1433 and 1431, 1432 provide a power connection and common connection, respectively, or contact elements 1430, 1433 provide a common connection and contact elements 1431, 1432 provide a power connection. The driver circuit 1200 elements, e.g., diodes D1, D2, D3, D5, D6, D7, capacitors C1, C2, C3, switches Q1, Q2, resistors R1 (e.g., 8.1 k), R2 (e.g., 1 k), processor U1 and inductor L2 (e.g., 22 microhenry), drive power to the LED 1410 (D4). Since each lighting element 1400 includes its own driver circuit 1200, a heat sink, e.g., copper connected with the LED, is enough to dissipate all the heat. Therefore a heat sink external to the lighting elements 1400 is not needed.

Many modifications and other embodiments set forth herein will come to mind to one skilled in the art having the benefit of the teachings presented in the foregoing descriptions and the associated drawings. Although specific terms are employed herein, they are used in a generic and descriptive sense only and not for purposes of limitation.

The invention claimed is:

1. A light module, comprising:

a plurality of lighting elements, each lighting element having four corners, and including:

one or more light emitting diodes (LEDs);

an LED driver circuit to provide constant current to the LEDs and receive modulated control information, the LED driver circuit configured to control activation and dimming of the LEDs on the lighting element;

a power block operatively coupled with the LED driver circuit, the power block having two power terminals of a first polarity electrically coupled together and physically disposed on opposite corners of a first diagonal the corresponding lighting element, and two power terminals of a second polarity electrically coupled together and physically disposed on opposite corners of a second diagonal of the corresponding lighting element, such that any two adjacent power terminals of one power block have opposite electrical polarity;

the lighting elements being connected vertically and horizontally to an adjacent lighting element to form a predetermined pattern of lighting elements on the light module, including a first lighting element connected to a second lighting element in any of four ninety-degree rotational orientations so that an electrical connection is made between two adjacent power terminals of a side of the first lighting element and two adjacent power terminals of a corresponding side of the second lighting element;

the power block further including a plurality of diodes and one capacitor, and operatively connected to the power terminals, and configured to provide the modulated control information to the corresponding LED driver circuit and provide the modulated control information to adjacent lighting elements through the power terminals of the first and second polarity without regard to the electrical polarity of the power terminals, based on a selected rotational orientation of the first or second lighting element.

2. The light module of claim 1, where a drop in voltage on the connection of the lighting elements does not affect an intensity of the light emitting diodes.

3. The light module of claim 1, where the power block determines address and light intensity information for the corresponding lighting element from a modulated power received by the power terminals.

4. The light module of claim 1, where the light emitting diode comprises multiple light emitting diodes of varying colors to produce a resulting mixed light color.

5. The light module of claim 1, where the lighting elements are split into sections by isolating a power across lighting element borders.

6. The light module of claim 1, where the connection between lighting elements thermally dissipates heat without an independent lighting element heat sink.

7. A light module, comprising:

a connection module including connection elements;

a first lighting element to connect with the connection elements of the connection module, where the first lighting element electrically and mechanically connects with the connection elements;

a first power block in the first lighting element having two power terminals of a first polarity electrically coupled together and physically disposed on opposite corners of the first lighting element, and two power terminals of a second polarity electrically coupled together and physically disposed on opposite remaining corners of the first lighting element, the power terminals operatively coupled to the corresponding connection elements; a plurality of power terminals disposed symmetrically at four opposite portions of the first lighting element;

a second lighting element, wherein the second lighting element shares two connection elements with the first lighting element;

a second power block in the second lighting element having two power terminals of a first polarity electrically coupled together and physically disposed on opposite corners of the second lighting element, and two power terminals of a second polarity electrically coupled together and physically disposed on opposite remaining corners of the second lighting element, the power terminals operatively coupled to the corresponding connection elements; wherein each power block includes a plurality of diodes and one capacitor and is operatively connected to corresponding power terminals so as to provide modulated control information to an LED driver circuit and provide the modulated control information to adjacent lighting elements through the power terminals of the first and second polarity without regard to the electrical polarity of the power terminals, based on a selected rotational orientation of the first or second lighting element; and wherein the first and second lighting element simultaneously receives control information in a parallel manner.

8. The light module of claim 7, where the connection module includes a surface, the connection elements are position on the surface, and the first lighting element and a plurality of additional lighting elements configured to be mounted horizontally or vertically to cover the surface.

9. The light module of claim 8, where the plurality of lighting elements are positioned in a pattern on the surface.

10. The light module of claim 7, where the lighting element connects with four connection elements.

11. The light module of claim 10, where two of the connection elements comprise power connections and two of the connection elements comprise common connections.

12. The light module of claim 11, where the two power connections are positioned diagonal to each other and the two common connections are positioned diagonal to each other.

13. The light module of claim 7, where the connection element connects with only a corner of the lighting element.

14. The light module of claim 13, where the connection element is configured to connect with corners of four lighting elements.

15. The light module of claim 7, where two adjacent corners of the lighting element include opposite polarities.

16. The light module of claim 15, where the lighting element is configured to be positioned on the connection module at 90, 180 or 270 degrees without affecting functionality of the lighting module.

17. The light module of claim 7, where the connection module is configured to be split into separate circuit zones.

18. The light module of claim 7, where the lighting element is addressable.

19. The light module of claim 7, further comprising a second lighting element, a first driver circuit, and a second driver circuit, where the first driver circuit connects with the first lighting element and a second driver element connects with the second lighting element.

20. The light module of claim 7, further comprising a driver circuit, where the driver circuit receives an addressed, modulated voltage containing information for operating the lighting element.

21. The light module of claim 7, further comprising a driver circuit, where a maximum voltage is stored by a capacitor of the driver circuit to regulate voltage to the lighting element.

22. A lighting element, comprising:

a first surface;

a driver circuit connected with the first surface;

a plurality of light emitting diodes connected with the first surface and the driver circuit, the plurality of light emitting diodes including a heat sink;

a first power block connected to the first surface and having two power terminals of a first polarity electrically coupled together and physically disposed on opposite corners of the first surface, and two power terminals of a second polarity electrically coupled together and physically disposed on opposite remaining corners of the first surface; and the first power block further including a plurality of diodes and one capacitor, operatively connected to corresponding power terminals so as to provide modulated control information to the driver circuit and to provide the modulated control information to additional surfaces through the power terminals of the first and second polarity without regard to the electrical polarity of the power terminals, based on a selected rotational orientation of the first surface or the additional surfaces.

23. The lighting element of claim 22, where adjacent power terminals include opposite polarity.

24. The lighting element of claim 22, where the light emitting diode comprises a string of light emitting diodes.

25. The lighting element of claim 22, where the driver circuit received information to control a dimming level of the light emitting diode.

* * * * *